United States Patent [19]

Weber, James L.

[11] Patent Number: 4,901,793

[45] Date of Patent: Feb. 20, 1990

[54] NO-TURN TOOL FOR A PUMPING SYSTEM

[76] Inventor: Weber, James L., P.O. Box 938, Weyburn, Saskatchewan, Canada, S4H 2L2

[21] Appl. No.: 287,876

[22] Filed: Dec. 21, 1988

Related U.S. Application Data

[62] Division of Ser. No. 80,754, Jul. 31, 1987, Pat. No. 4,811,785.

[51] Int. Cl.[4] ..... E21B 43/00

[52] U.S. Cl. ..... 166/68.5; 166/210; 166/217; 166/241

[58] Field of Search ..... 166/117.7, 210, 216, 166/217, 241, 242, 138, 139, 68.5, 68, 105; 175/230; 418/48

[56] References Cited

U.S. PATENT DOCUMENTS

| | | | |
|---|---|---|---|
| 2,753,943 | 7/1956 | Morgan | 166/216 |
| 2,765,855 | 10/1956 | Reed | 166/217 |
| 3,128,826 | 4/1964 | Brown | 166/134 |
| 3,279,542 | 10/1966 | Brown | 166/216 |
| 3,279,544 | 10/1966 | Tausch et al. | 166/216 |
| 3,342,269 | 9/1967 | Garrett | 166/137 |
| 3,528,500 | 9/1970 | Brown | 166/212 |
| 3,556,216 | 1/1971 | Condra | 166/215 |
| 3,643,737 | 2/1972 | Current et al. | 166/216 |
| 3,664,417 | 5/1972 | Conrad | 166/216 |
| 4,311,196 | 1/1982 | Beall et al. | 166/134 |
| 4,313,498 | 2/1982 | Anderson | 166/206 |
| 4,317,485 | 3/1982 | Ross | 166/216 |
| 4,340,116 | 7/1982 | Weise | 166/215 |
| 4,408,670 | 10/1983 | Schoeffler | 175/298 |
| 4,437,517 | 3/1984 | Bianchi et al. | 166/120 |
| 4,489,781 | 12/1984 | Weeks | 166/208 |
| 4,496,000 | 1/1985 | Weeks | 166/382 |
| 4,580,631 | 4/1986 | Baugh | 166/210 |
| 4,605,062 | 8/1986 | Klumpyan et al. | 166/131 |
| 4,669,555 | 6/1987 | Petree | 418/48 |

*Primary Examiner*—Stephen J. Novosad
*Assistant Examiner*—Terry Lee Melius
*Attorney, Agent, or Firm*—Irell & Manella

[57] ABSTRACT

Designed primarily for use in the production of heavy and medium oil in conjunction with a screw-type pump in relatively shallow or medium wells, the device comprises an inner mandrel within an outer casing situated below the pump and connected to the pump casing and prevents right-hand rotation in the event that the torque reaction of the pump increases due to sand, for example, and attempts to rotate the pump stator together with the production string tubing, but at the same time allows vertical movement of the string to take place for withdrawal purposes. Once the production string together with the pump and the no-turn tool is lowered to the desired position, drag blocks engage the well bore casing thus holding or steadying the outer casing while the inner mandrel is rotated slightly so that cams thereon force slips into contact with the well casing thus preventing right-hand rotation of the outer casing which, because it is connected to the stator casing of the pump and to the production tubing, also prevents right-hand rotation of these parts thereby preventing separation at the loosest joint. Shear pins are provided in the event that the slips catch in a casing joint, casing perforations or the like when withdrawing the tool and a shear ring on the mandrel shears these pins when vertical movement of the assembly is initiated thus clearing the cams from the slip blocks so that slip springs retract the slips and allow withdrawal to continue.

11 Claims, 2 Drawing Sheets

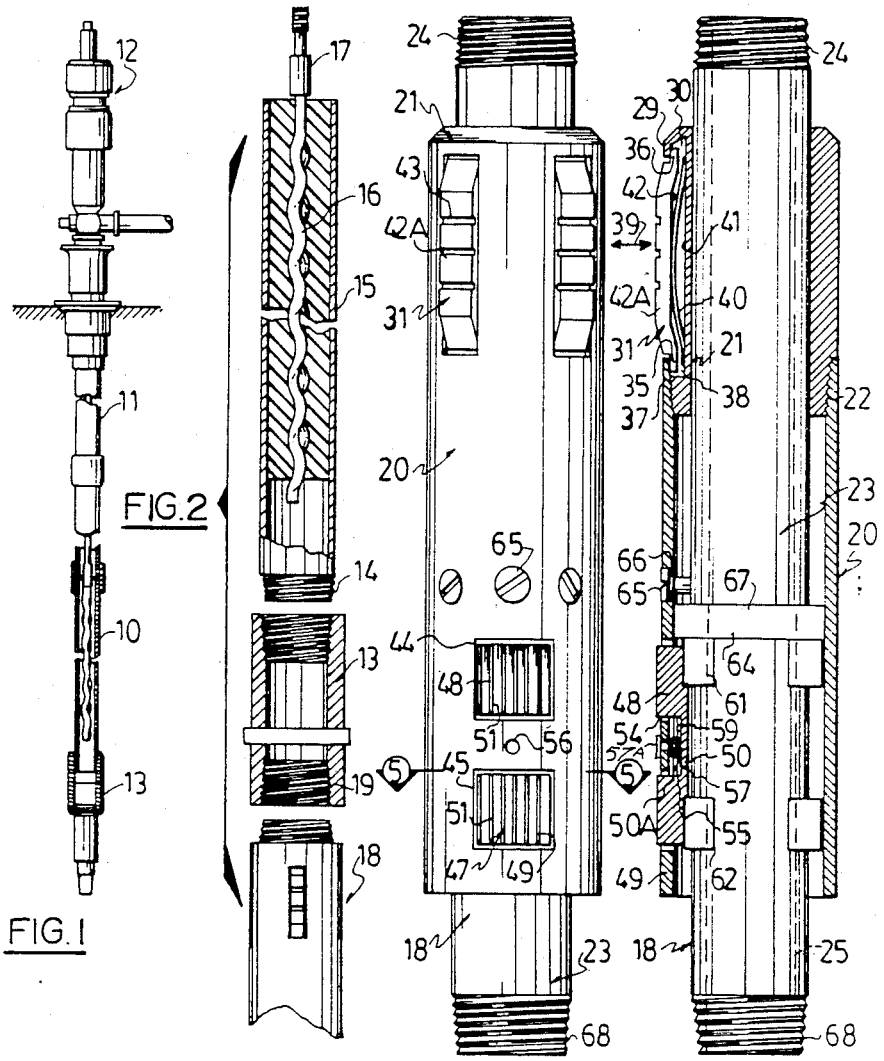
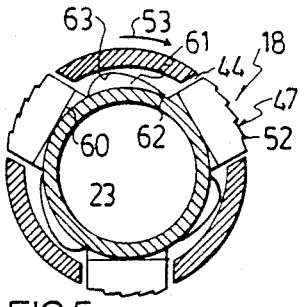
FIG.5
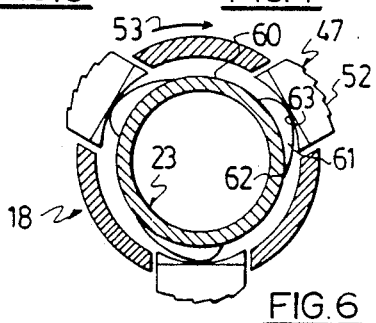
FIG.6

NO-TURN TOOL FOR A PUMPING SYSTEM

This application is a division of application Ser. No. 080,754, filed 7/31/87 now Pat. No. 4,811,785.

BACKGROUND OF THE INVENTION

This invention relates to new and useful improvement in oil well tools, designed primarily for use with a screw-type pump normally operated in shallow to medium wells in which the screw-type pump conventionally operates by rotating the rod string to the right when viewed from the upper end thereof, inside the production string.

Conventionally, reciprocating pumps operate by moving the rod string up and down inside the production string and under these circumstances, with no rotation, a conventional tubing anchor is most efficient in such pumping operations. However it is not suitable for use with a screw-type pump normally used in shallow or medium wells that produce a lot of sand with the oil.

When a conventional tubing anchor fills with sand, it usually will not release with rotation. Also it can be extremely difficult in practice, to shear the anchor as the shear valve has to be fairly high in the string due to the nature of its operation. A conventional tubing anchor is not suitable because unless a significant amount of tension is put on the production string, the anchor will release as all tubing anchors known to applicant release to the right inasmuch as these anchors use left-hand rotation to set and right-hand rotation to release.

Unfortunately, when used with a screw-type pump, which is rotated to the right when viewed from above, sand contained with the oil will often fill the pump or the annulus and the weight of the head of fluid within the production casing will pack this sand solidly so that the rotor of the pump cannot be rotated. The torque reaction therefore tends rotate the stationary production tubing so that the pump casing and the production tubing string will also attempt to rotate and will normally rotate at the loosest joint in the string thus dropping the pump into the well sometimes together with much of the production tubing whereupon considerable time and effort must be expended in order to fish and retrieve these parts.

Furthermore, conventional tubing anchors do not permit vertical movement which is the only way in most instances, to free a sand filled pump or annulus.

Also, temperature variations which occur, often cause elongation and contraction of the equipment which is difficult to compensate for when no vertical movement is possible.

The present invention overcomes all of the these disadvantages by providing a no-turn tool at the lower end of the pump assembly and providing means to frictionally engage the tool casing and hold it stationary while setting slip blocks into the well casing thus preventing right-hand rotation from occurring during operation. This prevents the torque reaction of a pump auger assembly from rotating the pump casing and undoing production tubing joints as hereinbefore described yet at the same time does not prevent vertical movement from being initiated. This vertical movement is often needed if a sand filled pump or annulus is present particularly in view of the head of fluid which will pack this sand solidly so that the pump cannot be rotated in order to release same.

The vertical movement facility provided also takes care of temperature variations which may cause elongation and contraction of the string within the well bore.

PRIOR ART

Prior art known to applicant include the following U.S. Pat. Nos.:

U.S. Pat. No. 2,753,943 C. K. Morgan July 10, 1956. This discloses a setting device to manipulate down hole equipment and is not designed to prevent rotation in either direction in the event of a rotary pump jamming.

U.S. Pat. No. 2,765,855 J. E. Reed Oct. 9, 1956. This discloses a tubing anchor which prevents vertical movement or oscillation to the lower end of the tubing string and during a reciprocal pumping action.

U.S. Pat. No. 3,128,826 C. C. Brown Apr. 14, 1964. This discloses a well packer assembly which is used to isolate zones and prevent vertical movement of the string.

U.S. Pat. No. 3,279,544 G. H. Tausch et al, Oct. 18, 1966. This also shows a well packer used for zone isolation and preventing vertical movement.

U.S. Pat. No. 3,342,269 H. U. Garrett Sept. 19, 1967. This shows an anchor for a well tool adapted for use with a well packer which will hold the tool against movement in one direction relative to the well piping which the tool is located. No means are shown to prevent rotation in either direction.

U.S. Pat. No. 3,528,500 J. R. Brown Sept. 15, 1970. This shows a tubing anchor for well tubing strings which employs hydrostatic pressure to actuate the anchor means and right-hand rotation of the tubing string in order to release so that it is not suitable for use with a screw-type pump.

U.S. Pat. No. 3,556,216 Elmo I. Condra Jan. 19, 1971. This shows a pump anchor for deep wells. This discloses a locking mechanism when the sleeve is rotated clock-wise by pump vibration and by gravity action due to the steep helical track on the sleeve resting on a fixed lug on the mandrel. Release is effective by the lifting of the slip mounting sleeve relative to the mandrel by action of the mandrel lug on the helical track when pump tubing is rotated clockwise.

U.S. Pat. No. 3,643,737 James H. Current et al, Feb. 22, 1972. This shows a slip assembly for a well tool designed specifically to prevent vertical movement only.

U.S. Pat. No. 3,664,417 Martin B. Conrad May 23, 1972. This also prevents vertical movement and is not designed to prevent rotation.

U.S. Pat. No. 4,311,196 Beall et al, Jan. 19, 1982. This is a tangentially loaded slip assembly used to prevent vertical movement and is not designed to prevent right-hand rotation.

U.S. Pat. No. 4,317,485 Richard J. Ross Mar. 2, 1982. This shows a pump catcher apparatus used to prevent the tubing strings from falling and prevents downward movement only.

U.S. Pat. No. 4,340,116 Stanley A Weise Jul. 20, 1982. This is a slip deployment mechanism for use with a packer in a tubing string. It is designed specifically with a slip deployment mechanism and is not designed to prevent rotation in either direction.

U.S. Pat. No. 4,408,670 William N. Schoeffler Oct. 11, 1983. This for open hole use in order to assist drilling and is used with an impact tool.

U.S. Pat. No. 4,313,498 Eric J. Anderson Feb. 2, 1982. This device is used to stabilize equipment, i.e. a centrifical pump in a well bore and is designed to prevent lateral and side movement, i.e. wobbling and is not designed to prevent rotation.

U.S. Pat. No. 4,437,517 David C. Bianchi et al, Mar. 20, 1984. This shows a slip mechanism for wells for the anchoring of a production string to a well casing thus preventing vertical movement from occurring.

U.S. Pat. No. 4,489,781 Benjamin R. Weeks Dec. 25, 1984. This shows a device which is used to suspend a liner in the casing in order to prevent downward movement only.

U.S. Pat. No. 4,496,600 Benjamin R. Weeks Jan. 29, 1985. Shows a device which is used to suspend a liner inside of a casing and prevents downward movement only as in the previous reference.

All of the tubing anchors known to applicant use left-hand rotation to set and right-hand rotation to release with the exception of Pat. No. 3,556,216 which uses vibration to set and right-hand rotation to release. This is because none of these anchors are designed to be used with screw-type pumps.

In accordance with the invention there is provided means to pump oil from an oil well having a casing therein, said means comprising in combination a production string having stationary tubing and a rotary pump drive means therein, a screw-type pump operatively connected to the lower end of said string, said pump including a stator casing and a screw-type rotor rotatable therein, and a no-turn tool operatively secured to the lower end of said stator casing to prevent right-hand rotation of said stator and said production tubing.

Another advantage of the invention is to provide a no-turn tool comprising in combination an outer body portion, an inner mandrel within said body portion, drag blocks extending through the wall of said outer body portion and further means, in co-operation with cam means on said mandrel extending through the wall of said outer body portion adapted to engage an associated well casing to prevent right-hand movement of said mandrel.

The invention described herein, is simple in construction, economical in operation and otherwise well suited for the purpose for which it is designed.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

FIG. 1 shows, in reduced scale, a schematic front elevation of a screw-type pump connected to a production string and well head equipment and showing, in exploded view the location of the no-turn tool.

FIG. 2 is an enlarged view of the screw-type pump sectioned in part together with a conventional collar to which the no-turn tool is shown in exploded relationship.

FIG. 3 is a front elevation of the no-turn tool.

FIG. 4 is a view similar to FIG. 3 but shown partly in section and with the outer body portion removed.

FIG. 5 is a cross-sectional view along the line 5—5 of FIG. 3 and showing the slip blocks retracted.

FIG. 6 is a view similar to FIG. 5 but showing the slip blocks extended.

the drawings like characters of reference indicate corresponding parts in the different figures.

BRIEF DESCRIPTION

Figure 8:
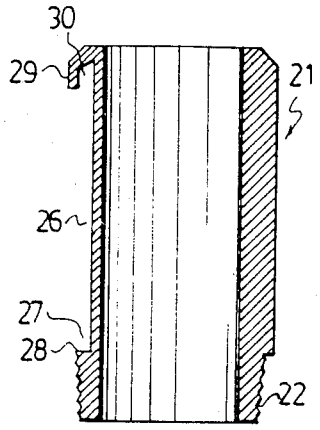
FIG. 8 is a cross-sectional view along the lines 8—8 of FIG. 7.

Referring first to FIGS. 1 and 2, reference character !0 shows a rotary pump connected to the lower end of a production string 11 which in turn is connected to well head equipment collectively designated 12 all of which is conventional.

A collar 13 screw-threadably engages the screw-threaded lower end 14 of the stator casing 15 of the pump 10 and rotor 16 rotates within this casing and is connected to the rod string 17 rotatable from the well head within the production tubing string 11.

The lower end of collar 13 provided with a conventional internal screw-thread similar to the one at the upper end of the collar and this receives the no-turn tool collectively designated 18, reference character 19 indicating this screw-thread at the lower end of the aforementioned collar 13.

In general, the no-turn tool 18 includes a slip casing 20 which is normally cylindrical, to the upper end of which is screw-threadably secured a drag block casing 21 as indicated at 22 in FIG. 4.

An internal mandrel collectively designated 23 extend the full length of the slip casing 20 and drag block casing 21 with a conventional tape and screw-thread 24 formed on the upper end thereof by which the no-turn tool 18 is attached to the lower end of collar 13 as hereinbefore described. This inner mandrel is provided with a longitudinally extending bore 25 through which oil is transferred by means of the aforementioned pump assembly 10.

DETAILED DESCRIPTION

Figure 7:
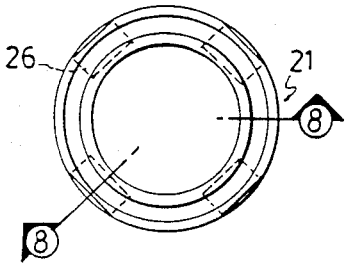
FIG. 7 is a top plan view of the drag block housing per se.

In detail, the drag block casing 21 shown in cross-section in FIGS. 4 and 7, comprises a cylindrical shell with a screw-threaded lower end as at 22 which engages the internal screw-threads at the upper end of the slip casing 20 and a plurality of equadistantly spaced, vertically situated rectangular recesses 26 are formed around the outer surface of the wall of this drag block casing. The lower ends 27 of these recesses terminate in an outturned shoulder 28 at the upper ends of the screw threads 22 and the upper end of the recesses is provided with an upwardly situated overhanging flange 29 defining with the wall of the drag block casing, a partially annular recess 30.

Figure 9:
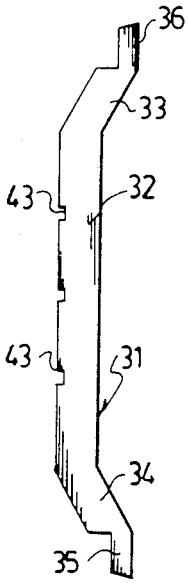
FIG. 9 is a side elevation of one of the drag blocks.
Figure 11:
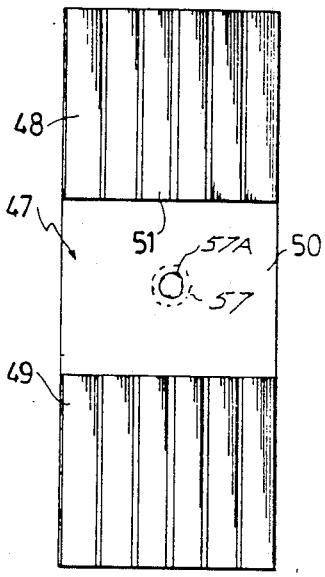
FIG. 11 is a front elevation of one the slip blocks.
Figure 10:
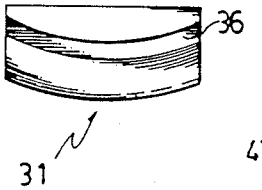
FIG. 10 is a top plan view of FIG. 9.
Figure 12:
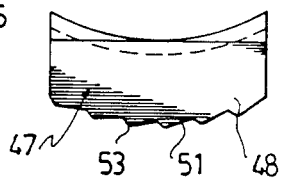
FIG. 12 is a top plan view of FIG. 11.

Each recess 26 is provided with a drag block collectively designated 31 and shown in detail in FIGS. 9 and 10. These drag blocks are arcuately curved and include the vertical portion 32, an inwardly inclining upper end portion 33 and an inwardly inclining lower end portion 34.

A vertical retaining portion 35 extends downwardly from the lower end of the portion 34 and a similar retaining portion 36 extends upwardly from the upper end of the inclining portion 33.

Reference to FIG. 4 will show that the wall of the slip housing 20 extends upwardly from the upper screw-thread portion 22 thus defining with the lower end of the wall of the drag block casing, and arcuately curved recess 38 into which the lower end retaining portion 35 of the drag blocks loosely engages.

Similarly, the upper retaining portion 36 of the drag blocks 31 loosely engages within the recess 30 formed at the upper end of the drag block housing. This permits the drag blocks to move transversely within the limits of the recesses 30 and 38, in the direction of doubled-headed arrow 39. A vertically situated leaf spring 40 reacts between the outer surface of the wall 41 within the recess 26 and the inner surface 42 of the drag blocks normally urging these drag blocks outwardly to the position shown in FIG. 4.

These drag blocks are provided with arcuately curved transversely situated recesses 43 in spaced apart relationship formed on the outer surface 42A thereof which assists in the frictional engagement of the drag blocks with the well casing as will hereinafter be described.

Formed through the wall of the slip casing 20, and preferably equadistantly spaced there around, is an upper set of substantially rectangular apertures 44 and a lower set of apertures 45 situated vertically below the corresponding upper apertures 44 with a connecting wall portion 46 therebetween and a slip collectively designated 47 is mounted through each corresponding upper and lower aperture as clearly shown in FIG. 4. These slips are provided with an upper portion 48 and a lower portion 49 with a bridging portion 50 connecting same and reference to FIG. 4 will shown that the thickness of the wall of the bridging portion is considerably less than the thickness of the upper and lower portion 48 and 49 thus defining an open-faced recess 50A between the portions 48 and 49 and which engages behind the connecting wall portion 46 of the slip housing.

Each slip portion 48 and 49 is provided with vertically situated wickers and teeth 51 terminating in edge sharpened outer edges 52 in the form of ratchet type teeth said leading outer edges inclining forwardly in the direction of the clock-wise rotation indicated in FIG. 6 by arrow 53.

The lower edge 54 of the upper portion 48 and the upper edge 55 of the lower portion 49 of each slip defines with the inner wall 59 of the bridging portion, the aforementioned recess 50A and the slips are freely moveable inwardly and outwardly of the apertures 44 and 45. However the slips are normally retained in the innermost position by means of a compression spring 58 mounted within a spring seat 57 on the inner side of the connecting wall portion 46 and reacting between the wall portion 46 and the surface 59 of the recess 50A all of which is clearly shown in FIG. 4.

When in the retracted position shown in FIG. 5, the springs 58 urge the slips against the outer surface 60 of the inner mandrel 23.

An upper and lower cam 61 extends outwardly from the mandrel 23, there being one such cam for each slip 47 and the profile of these cams increasing from a zero position common with the outer surface 60 of the mandrel and indicated by reference character 62, to a maximum indicated by reference character 63 with the profiles increasing in a anti-clockwise direction when viewed from above as shown in FIGS. 5 and 6 or in the opposite direction to arrows 53.

It will therefore be appreciated that if the inner mandrel 23 is rotated clockwise or in the direction of arrow 53 with the slip casing being held stationary by the drag blocks 31, the cams will force the slips outwardly to a position shown in FIG. 6 as will hereinafter be described.

A shear ring 64 is formed on the inner mandrel immediately above the upper cams 61 and this extends beyond the surface of the inner mandrel as shown in FIG. 4.

A plurality of screw-threadably engageable shear pins 65 are engaged through corresponding screw-threaded apertures 66 formed through the wall of the slip housing 20 just above the upper side 67 of the shear ring, the purpose of which will hereinafter be described.

In operation, the no-turn tool 18 is screw-threadably secured by the upper end 24 of the inner mandrel, to the lower end of collar 13 and of course it will be appreciated that further tubing (not illustrated) may be screw-threadably secured to the lower screw-threaded end 68 of the inner mandrel.

The slip housing 20 together with the drag block housing 21 being screw-threadably secured together are retained against end-wise movement, upon the mandrel by the engagement of the shear ring 64 upon the upper ends of the upper slip portions 48 thus preventing upwardly relative movement of the housings relative to the mandrel and by the shear pins 65 engaged by the upper side 67 of the shear ring which prevents downward movement of the housings relative to the mandrel.

While being lowered within the well, the slips 47 are retracted by springs 58 because the cams 61 are in the position shown in FIG. 5 and clear of the slips.

When the desired depth is reached, the drag blocks are engaging the well casing frictionally due to the pressure of springs 40 and creates resistance while the inner mandrel is rotated thus allowing the internal mechanism, namely, the cams and slips, to be operated.

As the mandrel is turned in a clock-wise direction when viewed from the upper side, that is, in the direction of arrow 53, the cams force the slips outwardly to the position shown in FIG. 6 thus engaging the wickers with the wall of the casing and the more the inner mandrel is turned, the tighter the wickers engage the casing thus preventing any rightward rotation of the outer housings and of course the production tubing which is operatively secured to the upper end 24 of the inner mandrel.

The pump may now be operated in a clock-wise direction as is conventional and any resistance to the rotation of the rotor within the stator cannot be transferred to the outer casing due to the locking action of the wickers of the slips with the wall of the well casing.

If the pump jams due to sand or other causes, anti-clockwise rotation of the inner mandrel by the drive string for the pump will normally back off the cams from the slips thus allowing the springs 58 to retract the slips so that the entire assembly can be withdrawn to the surface. If however the inner mandrel cannot be rotated then an attempt may be made to withdraw the assembly but if this is not possible o if the slips foul a casing joint or perforations within the casing, then further upward pressure upon the inner mandrel from the well surface, will cause the shear rings 64 to shear the pins 65 and further movement of the inner mandrel up or down, will move the cams 61 clear of the slips so that the springs 58 can move the slips inwardly. Further upward movement of the inner mandrel will engage the upper surface 67 of the shear ring 64 with the shoulder 69 extending inwardly from the lower end of the drag block housing 21 illustrated in FIG. 4 whereupon the entire assembly may be withdrawn and retrieved.

It will therefore be appreciated that no-turn tool differs from a conventional tubing anchor in a number of significant ways.

Firstly the tool is not designed to prevent vertical movement even when the tool is set or engaged as it will move upwardly and downwardly in the hole if required or if temperature variations cause this movement.

Secondly the tool is engaged or set in the well bore using right hand rotation in contrast to conventional tubing anchors that use left hand rotation to set same and right hand rotation to release.

Thirdly the tool is designed primarily to operate in shallow to medium wells that use a screw-type pump in which the screw operates by rotating the rod string to the right within the production string tubing.

The problem with this particular operating system is that right hand rotation can cause the bottom sections of the production string to rotate as well due to reaction if sand or the like is present and this can result in parted production strings.

A conventional tubing anchor is not suitable under the circumstances because unless a significant amount of tension is placed on the production string, the anchor will release because release of such anchors is caused by right hand or clock-wise rotation when viewed from the upper end thereof.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. Means to pump oil from an oil well having a casing therein, said means comprising in combination a production string having stationary production tubing and a rotary pump drive means therein, a screw-type pump at the lower end of said string, said pump including a stator casing coupled to the production tubing and a screw-type rotor rotatable in the stator casing and coupled to the pump drive means, and a no-turn tool operatively secured to the lower end of said stator casing, said no-turn tool comprising means for engaging an associated well casing to prevent right-hand rotation of the no-turn tool, said stator casing and said production tubing, said engaging means including vertically oriented slip means engageable with said well casing.

2. The device according to claim 1 in which said no-turn tool includes a slip housing and a drag block housing, an inner mandrel within said housings, means operatively connecting said inner mandrel with the lower end of said stator casing and hence to said production tubing, drag blocks extending through the wall of said drag block housing to engage the associated well casing and hold said no-turn tool stationary, and further means extending through said slip housing in co-operation with cam means on said mandrel, to engage said associated well casing thereby preventing right-hand rotation of said housings, said stator casing an said production tubing.

3. The device according to claim 2 which includes an apertured drag block housing secured to the upper end of said outer body portion, a plurality of radially situated drag blocks mounted within said drag block housing and protruding through the apertures in said drag block housing and spring means reacting between said drag block housing and said drag blocks normally urging said drag blocks outwardly through said apertures, each said drag block being substantially rectangular when viewed in front elevation and including at least one transverse groove formed across the outer surface thereof.

4. The device according to claim 2 in which said slip housing is apertured, a plurality of well casing engaging slips mounted within said slip housing and extending through the apertures within said slip housing, spring means reacting between said slip housing and said slips normally retracting said slips, said cam means including a cam lobe for each slip extending radially from said inner mandrel and engageable with an associated slip when right-hand rotation of said mandrel occurs relative to said slip housing thereby urging said slips outwardly through the apertures within said slip housing and into engagement with the associated well casing, each said slip having a serrated outer face forming vertically-oriented wickers, the leading outer edges of said serrations being situated to engage within the wall of the well casing when urged outwardly by said cams.

5. The device according to claim 3 in which said slip housing is apertured, a plurality of well casing engaging slips mounted within said slip housing and extending through the apertures within said slip housing, spring means reacting between said slip housing and said slips normally retracting said slips, said cam means including a cam lobe for each slip extending radially from said inner mandrel and engageable with an associated slip when right-hand rotation of said mandrel occurs relative to said slip housing thereby urging said slips outwardly through the apertures within said slip housing and into engagement with the associated well casing, each said slip having a serrated outer face forming vertically-oriented wickers, the leading outer edges of said serrations being situated to engage within the wall of the well casing when urged outwardly by said cams.

6. The device according to claim 4 in which each slip includes a substantially rectangular upper portion, a substantially rectangular lower portion, and a bridging portion therebetween, corresponding upper and lower apertures through the wall of said slip housing with a connecting wall portion therebetween, said upper and lower portions and said bridging portion of said slips forming a vertically situated upper and lower slip set, a set of cams on said inner mandrel for said upper set of slips and a set of cams on said inner mandrel for said lower set of slips, and a compression spring reacting between the inner wall of said connecting wall and said bridging portion of said slip normally retracting said slip against the inner mandrel clear of said cams.

7. The device according to claim 4 which includes means to selectively maintain the vertical relationship of said slips with said cams, said last mentioned means including a shear means extending from said inner mandrel and at least one shear pin extending inwardly from said slip housing spaced above said shear means and engageable thereby when upward movement of said mandrel relative to said slip housing is initiated, said shear means engaging the upper ends of said slips when downward movement of said mandrel relative to said slip housing is initiated and shoulder means in said housings extending inwardly and engageable by said shear means when said shear pins are sheared.

8. The device according to claim 5 which includes means to selectively maintain the vertical relationship of said slips with said cams, said last mentioned means including a shear means extending from said inner mandrel and at least one shear pin extending inwardly from said slip housing spaced above said shear means and engageable thereby when upward movement of said mandrel relative to said slip housing is initiated, said shear means engaging the upper ends of said slips when downward movement of said mandrel relative to said slip housing is initiated and shoulder means in said housings extending inwardly and engageable by said shear means when said shear pins are sheared.

9. The device according to claim 6 which includes means to selectively maintain the vertical relationship of said slips with said cams, said last mentioned means including a shear means extending from said inner mandrel and at least one shear pin extending inwardly from said slip housing spaced above said shear means and engageable thereby when upward movement of said mandrel relative to said slip housing is initiated, said shear means engaging the upper ends of said slips when downward movement of said mandrel relative to said slip housing is initiated and shoulder means in said housings extending inwardly and engageable by said shear means when said shear pins are sheared.

10. The device according to claim 1 in which the no-turn tool includes a slip housing, an inner mandrel within said housing, drag means operatively connected with said housing for frictionally engaging the associated well casing, slip means extending through the wall of said slip housing and cam means on said mandrel for displacing the slip means into engagement with the associated well casing to prevent right-hand rotation of said mandrel.

11. The device according to claim 10 in which said slip housing is apertured, said slip means comprise a plurality of well casing engaging slips mounted within said slip housing and extending through the apertures within said slip housing, spring means acting between said slip housing and said slips normally retracting said slips, said cam means including a cam lobe for each slip extending radially from said inner mandrel and engageable with an associated slip when right-hand rotation of said mandrel occurs relative to said slip housing thereby urging said slips outwardly through the apertures within said slip housing and into engagement with the associated well casing, each said slip having a serrated outer face forming vertically-oriented wickers, the leading outer edges of said serrations being situated to engage with the wall of the well casing when urged outwardly by said cams.

* * * * *